US008791882B2

(12) United States Patent
Tsuji

(10) Patent No.: US 8,791,882 B2
(45) Date of Patent: Jul. 29, 2014

(54) DISPLAY DEVICE OF ACTIVE MATRIX TYPE

(75) Inventor: Nobuhiko Tsuji, Yokosuka (JP)

(73) Assignee: Sharp Kabushiki Kaisha, Osaka (JP)

( * ) Notice: Subject to any disclaimer, the term of this patent is extended or adjusted under 35 U.S.C. 154(b) by 995 days.

(21) Appl. No.: 12/863,763

(22) PCT Filed: Oct. 23, 2008

(86) PCT No.: PCT/JP2008/069186
§ 371 (c)(1),
(2), (4) Date: Oct. 14, 2010

(87) PCT Pub. No.: WO2009/110132
PCT Pub. Date: Sep. 11, 2009

(65) Prior Publication Data

US 2011/0032243 A1 Feb. 10, 2011

(30) Foreign Application Priority Data

Mar. 6, 2008 (JP) ..... 2008-056680

(51) Int. Cl.
*G09G 3/30* (2006.01)
*G09G 3/32* (2006.01)

(52) U.S. Cl.
CPC ..... *G09G 3/3233* (2013.01); *G09G 2320/0233* (2013.01); *G09G 2320/043* (2013.01)
USPC ..... 345/76; 345/77

(58) Field of Classification Search
CPC ... G09G 3/3233; G09G 3/3241; G09G 3/325; G09G 3/3258; G09G 3/3283; G09G 2320/0233; G09G 2320/043; G09G 2300/0819
USPC ..... 345/76–83
See application file for complete search history.

(56) References Cited

U.S. PATENT DOCUMENTS

| | | | | |
|---|---|---|---|---|
| 2006/0221015 | A1 | 10/2006 | Shirasaki et al. | |
| 2007/0126667 | A1 | 6/2007 | Nakamura et al. | |
| 2008/0111812 | A1 * | 5/2008 | Shirasaki et al. | 345/212 |
| 2009/0231241 | A1 * | 9/2009 | Abe | 345/76 |

FOREIGN PATENT DOCUMENTS

| | | | |
|---|---|---|---|
| JP | 2004-252110 | A | 9/2004 |
| JP | 2004-361518 | A | 12/2004 |
| JP | 2006-284959 | A | 10/2006 |
| JP | 2006-301250 | A | 11/2006 |
| JP | 2007-179037 | A | 7/2007 |
| JP | 2007-206139 | A | 8/2007 |
| JP | 2008-139861 | A | 6/2008 |

* cited by examiner

*Primary Examiner* — Dwayne Bost
*Assistant Examiner* — Christopher Kohlman
(74) *Attorney, Agent, or Firm* — Rabin & Berdo, P.C.

(57) ABSTRACT

A display device of active matrix type allows reducing display brightness non-uniformity that is caused by initial variation and fluctuation over time in a driving transistor for emissive elements in pixel circuits. The display device includes pixel circuits, a measurement circuit and a gradation voltage supplying circuit. Each pixel circuit includes the driving transistor and an input circuit. The measurement circuit includes a constant current supplying circuit for generating and supplying one or more constant currents to the input circuit of the pixel circuits in a time division manner. The measurement circuit A/D-converts output voltages of the constant current supplying circuit and calculates data relating to electron mobility and threshold value of the driving transistor. The gradation voltage supplying circuit supplies to the pixel circuits a corrected gradation voltage, which is data corrected on the basis of data calculated from the measurement circuit.

12 Claims, 8 Drawing Sheets

DISPLAY DEVICE OF ACTIVE MATRIX TYPE

CROSS REFERENCE TO RELATED APPLICATIONS

This application is the national phase of international application number PCT/JP2008/069186, filed Oct. 23, 2008, and claims the benefit of priority of Japanese application 2008-056680, filed Mar. 6, 2008. The disclosures of the international application and the Japanese priority applications are incorporated herein by reference.

BACKGROUND OF THE INVENTION

The present invention relates to a self-emissive display device of active matrix type that uses, for instance, organic electroluminescence (EL) elements. More specifically, the present invention relates to a display device of active matrix type that allows supplying, to emissive elements, current having an appropriate brightness display gradation (tone of luminance) according to display data.

In image display devices that use organic EL materials or inorganic EL materials as electro-optic materials, the luminance of light emitted by the electro-optic material varies depending on the current with which pixels are written. EL display panels are self-emissive type panels having an emissive element at each pixel. EL display panels have various advantages vis-à-vis liquid crystal display panels, in that the former allow achieving, for instance, faster response speeds, smaller temperature dependence of the response speed, a wider gamut of reproducible colors, and higher visibility through a wide viewing angle and high emission efficiency, thanks to self emission, as well as a higher contrast.

Organic EL displays are driven according to a dot-matrix scheme, in the same way as liquid crystal displays. In organic EL displays, however, the brightness of each emissive element is controlled by the value of the current flowing therethrough, i.e. organic EL elements are current-controlled. Organic EL displays are hence significantly different from liquid crystal display, in which each cell is voltage-controlled. Dot-matrix driving can be fundamentally divided in active matrix driving, in which display data is written at a selection period and driving takes place thereafter based on the written values, and passive matrix driving, in which driving based on the display data is carried out only at the selection period. The basic circuits of active-matrix type organic EL display panels are well known.

FIG. 7 is a diagram illustrating an example of an equivalent circuit of one such pixel. The dotted line in the figure encloses a pixel circuit 10. The pixel circuit 10 comprises an EL element 11 that is an emissive element, a first transistor (driving transistor) 12, a second transistor (switching transistor) 13 and a capacitance (capacitor) 14. The emissive element 11 is an organic electroluminescence (EL) element.

The driver circuit that drives the pixel circuit 10 is not shown, but the configuration of the driver circuit is similar to that of driver circuits of liquid crystal display panels, in which a matrix is driven through output of signals that denote changes in the intensity of voltage corresponding to a video signal. Driving of organic EL display panels, however, is different from liquid crystal display in that, as pointed out above, organic EL elements are current-controlled, while liquid crystal displays are voltage-controlled.

In FIG. 7, the driver circuit applies a voltage signal, corresponding to a video signal, to a source signal line 15. With a gate signal line 16 (scan line) in a selected state, the transistor 13 is energized, whereupon the voltage signal applied to the source signal line 15 is written on the capacitor 14 and is held there. The gate potential of the transistor 12 is maintained stably by the capacitor 14 even when the gate signal line 16 (scan line) is in a non-selected state. The organic EL 11 continues emitting light at a brightness corresponding to the current determined by the written gate potential, unit the next writing.

Hereafter, the transistor 12 that supplies current to the EL element 11 illustrated in FIG. 7 will be referred to as driving transistor, and the transistor that operates as a switch for selecting an element in a matrix, such as the transistor 13 illustrated in FIG. 7, will be referred to as switching transistor.

The panels in organic EL display panels of active matrix type are built using transistors made up of low-temperature polysilicon or amorphous silicon. For various reasons, however, such transistors are difficult to form such that the transistors have a uniform characteristic, and non-negligible characteristic variation is a common occurrence. Such transistor characteristic variation, in particular variation in the characteristic of a driving transistor, precludes achieving uniform brightness in the organic EL element, even when the same driving transistor is driven in the same way. Variation in the characteristic of driving transistors in a same panel gives rise to display non-uniformity within the display.

FIG. 7 is a diagram illustrating the basic configuration of a voltage-programmed pixel circuit that drives a respective pixel. In voltage programming, a voltage signal such as a video signal denoted by voltage magnitude or voltage intensity changes is applied for instance to a data signal line, a source signal line or a pixel, whereupon the voltage signal is converted to a current signal by, for instance, the driving transistor of the pixel circuit, and the EL element is driven on the basis of the current signal.

Current programming refers to a configuration, circuit or driving method in which a current signal such as a video signal denoted by current magnitude or current intensity changes is applied for instance to a data signal line, a source signal line or a pixel, and a current signal substantially proportional to the applied current signal, or a current signal resulting from subjecting the applied current to a predetermined conversion processing, is directly or indirectly applied to the EL element.

In the pixel configuration illustrated in FIG. 7, the transistor 13 carries out a switching operation, as the name of switching transistor implies. Therefore, a variation in this transistor is comparatively non-influential to the overall characteristic. The transistor 12, called the driving transistor, however, drives the EL element by receiving the input of a video signal denoted by voltage intensity changes, and converting the video signal to a current signal. The driving transistor 12, therefore, carries out an analog operation, and hence any characteristic variation in the driving transistor 12 gives rise to variation in the converted current signal. The characteristic of the driving transistor 12 exhibits ordinarily a variation of 50% or higher.

In voltage programming, though, the charge-discharge ability of source signal lines and the like is high, both in low-gradation regions and high-gradation regions, and there occurs virtually no display non-uniformity caused by insufficient writing.

Display non-uniformity caused by the above-described transistor characteristic variation can be mitigated using a configuration based on current programming. Current programming, however, is problematic in that the driving current is small in low-gradation regions, which precludes achieving satisfactory driving on account of the parasitic capacitance of the source signal line 15.

In order to solve this problem, Japanese Patent Application Laid-open No. 2007-179037 discloses a method that combines the advantages of the above-described current programming and voltage programming. Also, Japanese Patent Application Laid-open No. 2006-301250 discloses the feature of measuring a threshold voltage (hereafter, an input voltage that does not contribute to gradation display will be referred to as threshold voltage) of the transistors that drive each EL element, and storing the measured threshold voltage for each EL element. The stored threshold value is used for generating a gradation execution voltage in accordance with display data, such that the generated gradation execution voltage is applied to the transistors that drive respective EL elements.

Threshold voltage can also be referred to as shift voltage, wherein voltage proportional to gradation data is shifted, in the correlation between the gate voltage of the driving transistor and the luminance of emitted light, to set a linear relationship between luminance of emitted light with respect to gradation data.

The above-described method, however, cannot completely compensate for the initial variation of the electron mobility and of the threshold voltage (hereafter, Vth) of the transistor characteristic, or for the fluctuation of the foregoing over time. FIG. 8 illustrates schematically the fluctuation over time of the above two characteristics in an example of a transistor made up of amorphous silicon. In this transistor, Vth rises in the figure from Vthi to Vthn, and electron mobility drops from $\alpha i$ to $\alpha n$ in the figure, on account of internal deterioration as driving hours go by. Therefore, when Vdata, which is the gradation signal, is constant, the driving current drops from Idi to Idn, and brightness drops accordingly in proportion to the drop in driving current. The characteristic change in such a driving transistor varies depending on the individual transistor in the matrix. Therefore, display brightness non-uniformity occurs in the display surface as time goes by, even when countermeasures are taken to cancel initial non-uniformity of display brightness. Initial variation can be linked to the occurrence of initial non-uniformity of display brightness by replacing the characteristic that exhibits fluctuation over time in FIG. 8 by the initial characteristic of each transistor.

In CMOS there holds the relationship $\mu=2LIds/WCi(Vg-Vth)^2$ between the above-described electron mobility ($\mu$) and other characteristics. In the above expression, L is the channel length, Ids is the drain current value in the saturation region, W is the channel width, Ci is the capacitance per unit area of the gate insulating layer, Vg is the gate voltage and Vth is the threshold voltage. It becomes apparent therefore that the fluctuation in electron mobility exerts a significant influence on the transistor characteristic, in particular on the ratio of node current change relative to gate voltage change.

SUMMARY OF THE INVENTION

In the light of the above issues, therefore, it is an object of the present invention to provide a display device that allows reducing display brightness non-uniformity, caused by initial variation and fluctuation over time of driving transistors in the pixel circuits of the display device, as compared with conventional display devices.

The display device of active matrix type of the present invention is a display device of active matrix type, in which a plurality of emissive elements of current control type, and a plurality of pixel circuits to which voltage comprising a gradation signal is inputted and which supplies a current to the emissive elements, are formed as a matrix, the display device comprising the pixel circuits that each comprise an input circuit having a characteristic that enables flow of an input current that is proportional to a current flowing through the emissive elements, and a measurement circuit that measures the characteristic of each pixel circuit.

The measurement circuit comprises a constant current supplying circuit capable of generating one or more constant currents and supplying the constant current to each input of the plurality of pixel circuits, and an A/D converter to which there is inputted an output voltage of the constant current supplying circuit and that A/D-converts the voltage. The measurement circuit supplies, by time division, the one or more constant currents to an input circuit of each pixel circuit by way of the constant current circuit, and performs A/D conversion according to that supply. The measurement circuit performs a predetermined operation on inputted A/D-converted data; calculates data relating to electron mobility and a threshold value of a driving transistor in the pixel circuits that supply current to the emissive elements; and stores the calculated data for each pixel circuit. The display device of active matrix type further comprises a gradation voltage supplying circuit. The gradation voltage supplying circuit is capable of executing a multiplication operation of data inputted thereinto including data representing gradation inputted to the display device and the data relating to the electron mobility received from the measurement circuit; adding the threshold value inputted from the measurement circuit to the result of the multiplication to generate a voltage for display, which is supplied to the pixel circuits; and supplying the voltage for display to the input of the pixel circuits.

The measurement circuit according to the present invention stops current supply after supply of a constant current of a first value from the constant current supplying circuit; creates first data through A/D conversion of the output voltage of the constant current supplying circuit after stoppage, and stores the created first data; and creates second data through A/D conversion of the output voltage of the constant current supplying circuit in a period in which there is supplied a constant current of a second value equal to or different from the first value, and stores the created second data. The measurement circuit calculates next a threshold value of the driving transistor of the pixel circuits on the basis of the stored first data; and calculates data relating to electron mobility of the driving transistor on the basis of the stored first and second data.

In the present invention, the constant current of the second value is a current of a value that corresponds to a maximum brightness set beforehand for the driving transistor.

In the present invention, the input circuit of the pixel circuits comprises a current mirror transistor of the driving transistor.

In the present invention, the voltage that yields the first data denotes a threshold value of the current mirror transistor after discharge, via the current mirror transistor, of voltage charged in a capacitor in the gate of the driving transistor.

In the present invention, the threshold value of the current mirror transistor corresponds to a threshold value of the driving transistor of the pixel circuits.

In the present invention, the input circuit of the pixel circuits comprises a current mirror transistor of a transistor that drives the emissive elements, and the voltage that yields the first data denotes a threshold value of the current mirror transistor after discharge, via the current mirror transistor, of voltage charged in a capacitor in the gate of the driving transistor of the pixel circuits. The constant current of the second value is a current of a value that corresponds to a maximum brightness set beforehand for the driving transistor, and the data relating to the electron mobility is expressed by $(Vn-Vth)/Vi$, wherein Vth is the first data, Vn is the second data, and Vi is data denoting maximum brightness in data that denotes gradation and that is inputted to the display device.

The display device of active matrix type of the present invention is also a display device of active matrix type, in which a plurality of emissive elements of current control type, and a plurality of pixel circuits to which voltage comprising a gradation signal is inputted and which supplies a current to the emissive elements, are formed as a matrix, the display device comprising the pixel circuits that each comprise an input circuit having a characteristic that enables flow of an input current that is proportional to a current flowing through the emissive elements; as well as a measurement circuit, a storage circuit and a gradation voltage supplying circuit. The measurement circuit comprises a constant current supplying circuit capable of generating one or more constant currents and supplying the constant current to each input of the plurality of pixel circuits. The measurement circuit can supply, by time division, the one or more constant currents to the input circuit of each pixel circuit by way of the constant current circuit, and can A/D convert an inputted output voltage of the constant current supplying circuit corresponding to the one or more constant currents. The storage circuit stores, for each pixel circuit, data calculated on the basis of data from the measurement circuit and that relates to electron mobility and a threshold value of a transistor in the pixel circuits that supply current to the emissive elements. The gradation voltage supplying circuit executes a multiplication operation of data inputted thereinto including data representing gradation inputted to the display device and the data relating to the electron mobility received from the measurement circuit; adds the threshold value inputted from the measurement circuit to the result of the multiplication, to generate a voltage for display, which is supplied to the pixel circuits; and supplies the voltage for display to the input of the pixel circuits.

The display device of active matrix type of the present invention is also a display device of active matrix type, in which a plurality of emissive elements of current control type, and a plurality of pixel circuits to which voltage comprising a gradation signal is inputted and which supplies a current to the emissive elements, are formed as a matrix, the display device comprising the pixel circuits that each comprise an input circuit having a characteristic that enables flow of an input current that is proportional to a current flowing through the emissive elements; as well as a measurement circuit and a gradation voltage supplying circuit. The measurement circuit comprises a constant current supplying circuit capable of generating one or more constant currents and supplying the constant current to each input of the plurality of pixel circuits. The measurement circuit can supply, by time division, the one or more constant currents to the input circuit of each pixel circuit by way of the constant current circuit; and can A/D convert an inputted output voltage of the constant current supplying circuit corresponding to the one or more constant currents. The gradation voltage supplying circuit is inputted with data denoting gradation that is inputted to the display device, and is capable of generating a voltage for display that is supplied to the pixel circuits, and of supplying the voltage for display to the input of the pixel circuits. The data denoting gradation and that is inputted to the display device is data corrected on the basis of data calculated on the basis of data from the measurement circuit and that relates to electron mobility and a threshold value of a transistor in the pixel circuits that supply current to the emissive elements.

DESCRIPTION OF THE PREFERRED EMBODIMENT

Figure 1:
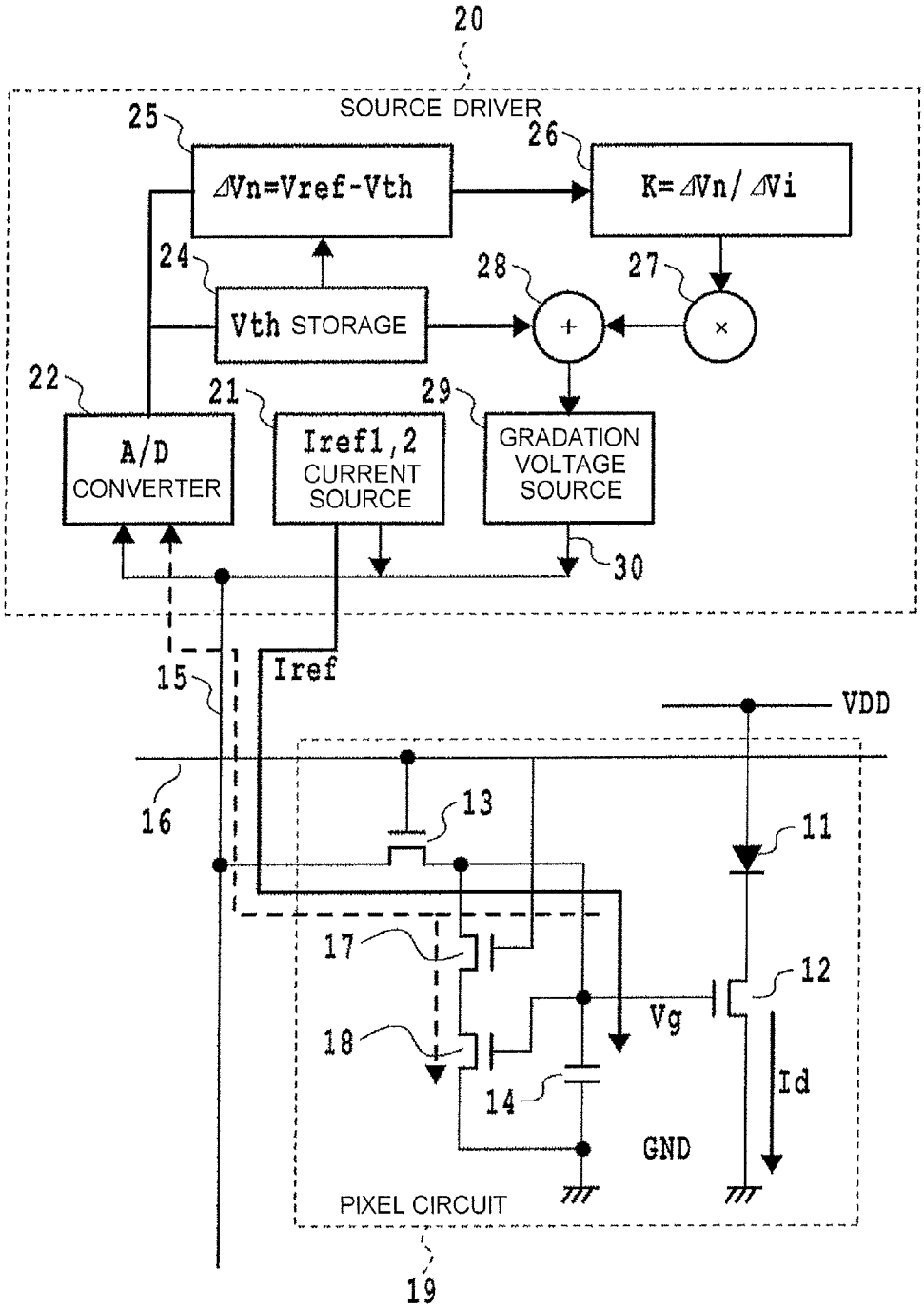
FIG. 1 is a diagram illustrating the configuration of an embodiment of the present invention, for explaining the operation of a calibration stage.

FIG. 1 is a diagram for explaining a driving circuit of the display device of active matrix type according to the present invention, and in particular a diagram for explaining a calibration stage according to the present invention. A source-driver circuit 20 (enclosed in the upper dotted line) includes a current source 21 that outputs a rated current, an A/D converter 22, a Vth storage circuit 24, a first computation and storage device 25, a second computation and storage device 26, a multiplier 27, an adder 28 and a gradation voltage source 29. Herein, the output of the current source 21, the input of the A/D converter 22 and the output of the gradation voltage source share a common line 30 and are connected to a source signal line 15 in each pixel circuit in an organic EL display device. Input and output to/from the foregoing are processed in time division. Although the gate-driver circuit is not shown, it has a plurality of gate signals 16 that sequentially operates a plurality of pixel circuits 19 in the column direction. The gate signals 16 are connected to corresponding respective pixel circuits 19.

Each pixel circuit 19 (enclosed in the lower dotted line) includes an EL element 11 as an emissive element, a driving transistor 12, a switching transistor 13, current mirror transistors 17, 18 and a capacitance (capacitor) 14. The transistors 18 and 12 are in a current mirror relationship. For a same gate voltage, therefore, the ratio between the Id of the transistor 18 and the Id of the transistor 12 is constant, depending on their size. If the size is the same, the current flowing through the transistors 18 and 12 is identical. In other words, when size is identical, the input current that flows through the input circuit of the pixel circuit via the source signal line 15 is the same as the current that flows through the organic EL 11. The pixel circuits 19 are formed in narrow regions. Therefore, the initial characteristics of the transistors within one pixel circuit 19 exhibit no discernible variation, and fluctuations over time can be regarded as substantially identical. Therefore, the characteristic of the driving transistor 12 can be read from the characteristic of the transistor 18, provided that the size of the transistors is known beforehand.

Although not shown in FIG. 1, the display data inputted into the display device is inputted into the multiplier 27.

Storage to and reading from the Vth storage circuit 24 and the second computation and storage device 26 is carried out for each pixel as described below. Reading can be performed for each pixel. Herein, the address selection operation of the pixel is performed in response to driving of the matrix.

The above configuration example of the organic EL display device according to the present invention, in particular the calibration example relating to a calibration stage, has been explained on the basis of the configuration illustrated in FIG. 1. An actual organic EL display device, however, includes a plurality of pixel circuits 19 in a row direction and a column direction, and has formed therein a matrix that includes a plurality of source signal lines and a plurality of gate signal lines.

An explanation follows next on the operation of the driving circuit of the EL display device illustrated in FIG. 1.

The present embodiment involves two operations, a calibration operation of obtaining a correction value through reading of transistor characteristics using a current source, and gradation display by way of a voltage source using the obtained correction value. The calibration operation will be explained first. The explanation below will deal with a single pixel circuit. In the operation of an actual display device the below-described operation is performed in each pixel circuit. To simplify the explanation, the transistors 18 and 12 below have both the same size.

(Calibration Operation)

Figure 2:
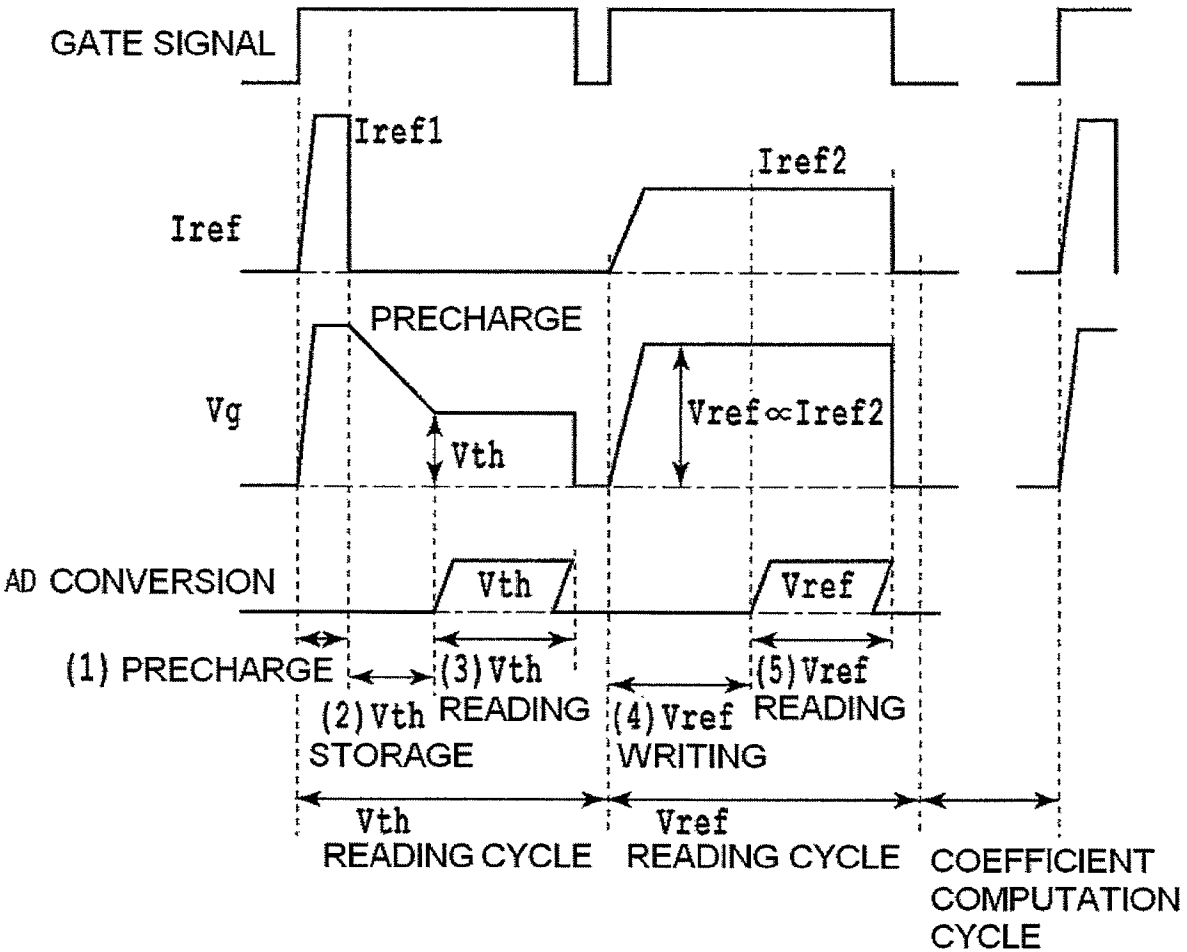
FIG. 2 is a diagram illustrating the operation timing of the calibration stage of FIG. 1.

FIG. 1 illustrates the configuration involved in the calibration operation. FIG. 2 illustrates the timing of the calibration operation. The calibration operation is carried out for each pixel. The calibration operation in each pixel can be divided into three operation cycles.

The operation of the first cycle involves reading and storing a threshold voltage Vth of the transistor 18, in order to read the threshold voltage of the driving transistor 12. The operation of the first cycle is shown in time series as a precharge period (1), a Vth storage period (2) and a Vth reading period (3).

In the precharge period (1), a current Iref1 greater than usual is applied to the pixel circuit 19 from the current source 21 alone (with the gradation voltage source off). During this period, therefore, the gate of the transistor 18 is at or above the threshold voltage. The Vth storage period (2) is a period in which Vth is stored, and in which input is discontinued in such a manner that the gate voltage of the transistor 18 changes to the threshold voltage. The gate voltage of the transistor 18, which has been raised to or above the threshold voltage, is discharged during that period via the transistors 17 and 18. Once the gate voltage of the transistor 18 drops to the threshold voltage, discharge from the transistors 17 and 18 ceases, and a constant voltage is sustained. This voltage is automatically stored in the capacitor 14. This voltage is the voltage at the time in which discharge from the transistors 17 and 18 breaks off. That is, the voltage is the threshold voltage of the transistor 18.

A voltage resulting from adding the saturation voltage of the transistor 17 to the above threshold voltage constitutes the input to the A/D converter 22. The conduction voltage of the transistor 17 is sufficiently small herein so as to be negligible, and is therefore not taken into consideration. In the Vth reading period (3) the above threshold voltage is converted to a digital value by the A/D converter 22. After a given time has elapsed, the digital value of the A/D-converted threshold value is stored in the storage circuit 24. The transistor 18 and the driving transistor 12 are formed within a same pixel, and hence have matched characteristics. The characteristic of the driving transistor 12 can be acquired through simulation. The threshold value Vth of the driving transistor 12 can be read therefore in the first cycle.

A characteristic relating to electron mobility is checked in the operation of the second cycle. In this operation, there is read and stored a voltage Vref at a time of flow of a reference current, and which constitutes the input of the A/D converter 22 at a time at which there flows a predetermined current. The operation of the second cycle is given by the time series of FIG. 2 and includes a Vref writing period (4) and a Vref reading period (5).

In the Vref period in (4) the current source 21 generates a reference current Iref2, for instance, a current corresponding to the current that flows to the organic EL element during 100% gradation. In the Vref reading period (5), the current of period (4) is sustained, and the gate voltage Vg of the transistor 18 at that time is read by the A/D converter 22. The voltage is generated at a rated current, and hence the voltage includes the threshold voltage of the transistor 18, which has the same characteristic of the transistor 12 or exhibits a predetermined correspondence with the characteristic of the transistor 12, as well as the electron mobility characteristic of the transistor. Therefore, a gate voltage Vref for which there flows current corresponding to 100% gradation can be read in the second cycle.

As will be apparent to a person skilled in the art, when the size of the transistor 18 is 1/a of the size of the driving transistor, the current Iref2 is 1/a of the current that flows in the organic EL element during 100% gradation.

The current path from the current source 21 is indicated in FIG. 1 by a bold line. The dotted line indicates that the A/D converter 22 detects a voltage substantially identical to the gate voltage of the transistor 18.

In the third cycle there is calculated a correction coefficient K. Equation (1) is computed, and the result temporarily stored, in the first computing unit 25, while equation (2) is computed, and the result temporarily stored, in the second computing unit 26, on the basis of the Vth obtained in the first cycle and the Vref obtained in the second cycle.

$$\Delta Vn = V\text{ref} - Vth \qquad \text{Equation (1)}$$

$$K = (\Delta Vn / \Delta Vi) \qquad \text{Equation (2)}$$

The value ΔVn corresponds to voltages that yield a gradation level from 0% to 100% of the measured pixel circuit at that time. The value ΔVi is an initial or reference voltage, determined beforehand, for instance a required data voltage during 100% gradation display.

Figure 5:
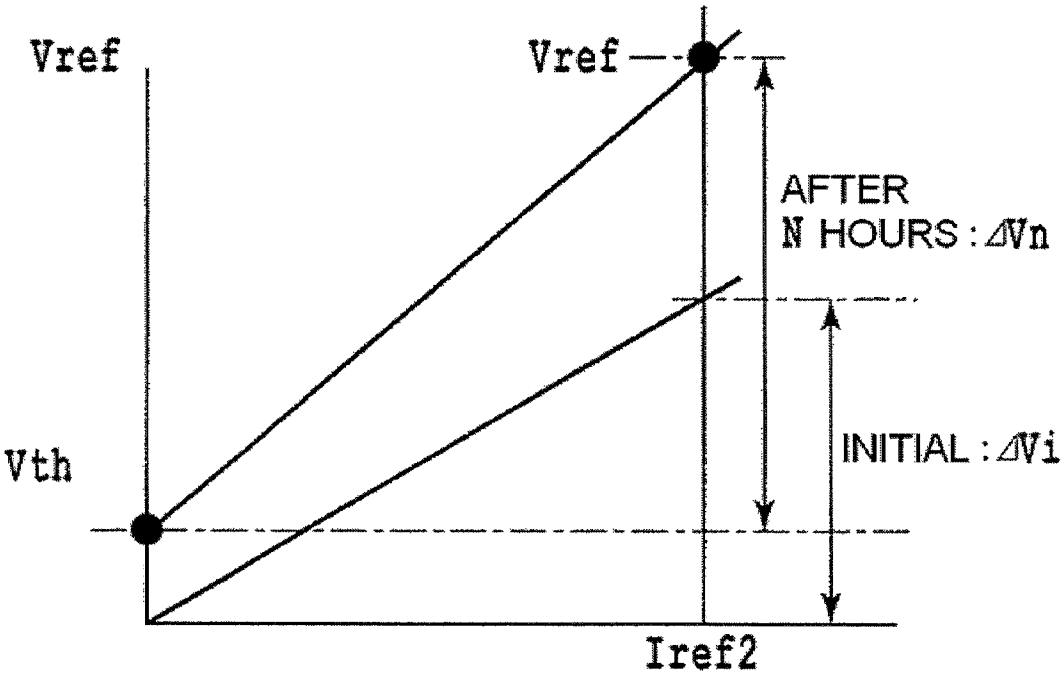
FIG. 5 is a diagram illustrating the change over time of a transistor characteristic.

An explanation follows next on the coefficient K obtained by the second computing unit 26. ΔVi is an initial or reference voltage, for instance data voltage that denotes a 100% brightness level in gradation display. In the actual transistor of interest, however, the voltage corresponding to ΔVi becomes ΔVn on account of initial variation and fluctuation over time. Therefore the coefficient K of this variation or fluctuation is worked out and is used for correction of gradation voltage, upon subsequent setting of the latter. FIG. 5 illustrates an example of the relationship between ΔVi and ΔVn.

In the above explanation, the detected values are substantially identical to the characteristic of the driving transistor. It is evident that, even if the values are not essentially identical, there is nonetheless a correspondence between them. The detected threshold value can also be processed as corresponding to the characteristic of the driving transistor. If a correspondence is known beforehand, the above-described reference current Iref2 can be set on the basis of that correspondence, and the K obtained as a result can be taken as an indicator of the value of the driving transistor.

In FIG. 5, for instance, the transistor had initially a characteristic denoted by the lower slanting line, but exhibited a characteristic denoted by the upper slanting line after N hours. Alternatively, FIG. 5 shows that although the signal denoting gradation is assumed to exhibit the characteristic indicated by the lower slating line, the signal characteristic to be actually inputted to the pixel circuit must have a characteristic corresponding to the characteristic indicated by the upper slanting line. The above-described operation is carried out for each pixel circuit.

An explanation follows next on the display operation at the gradation corrected by the voltage source.

(Gradation Display Operation)

Figure 3:
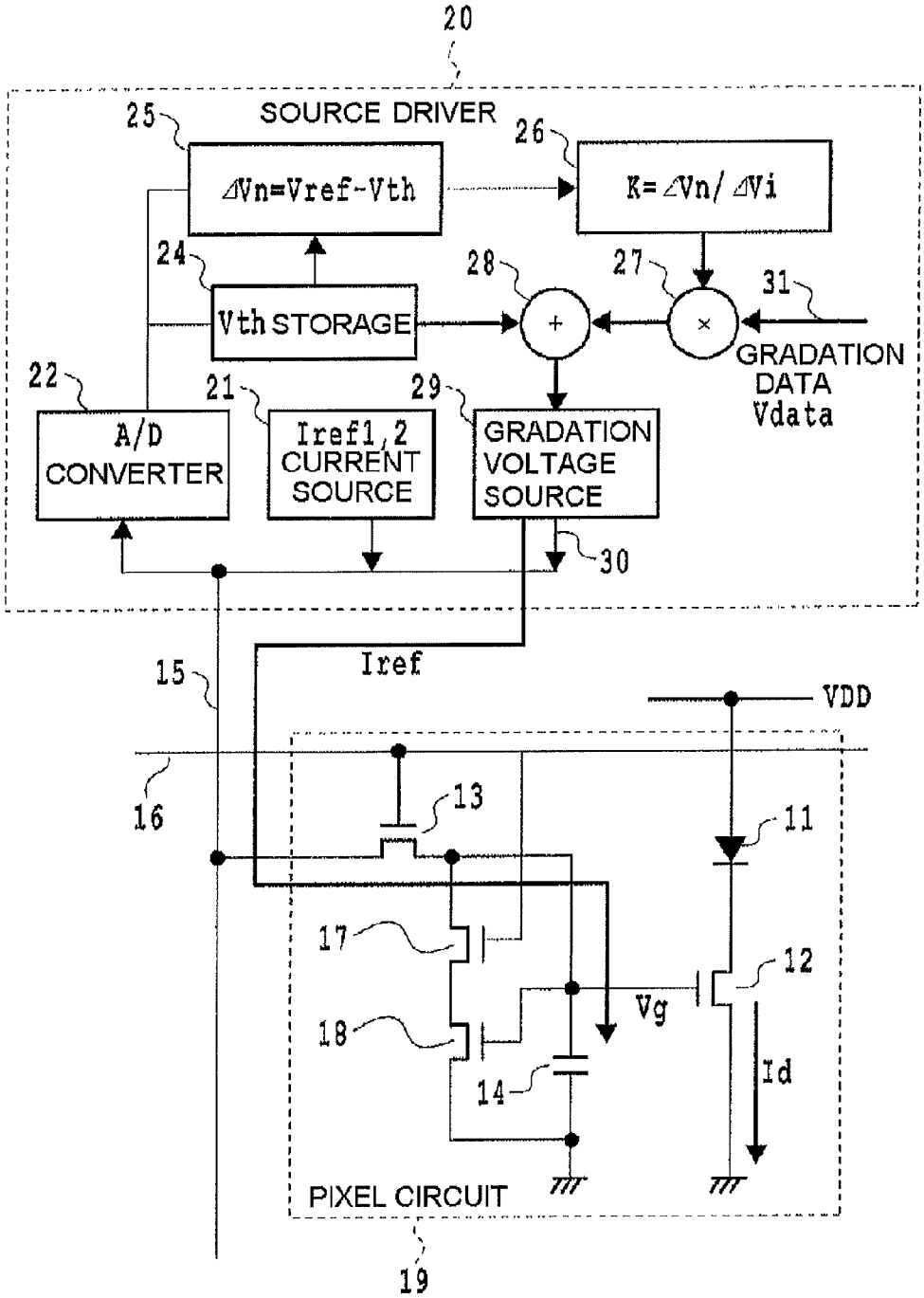
FIG. 3 is a diagram illustrating the configuration of the embodiment of the present invention, for explaining the operation at a stage of gradation display according to an input digital of a display device.
Figure 4:
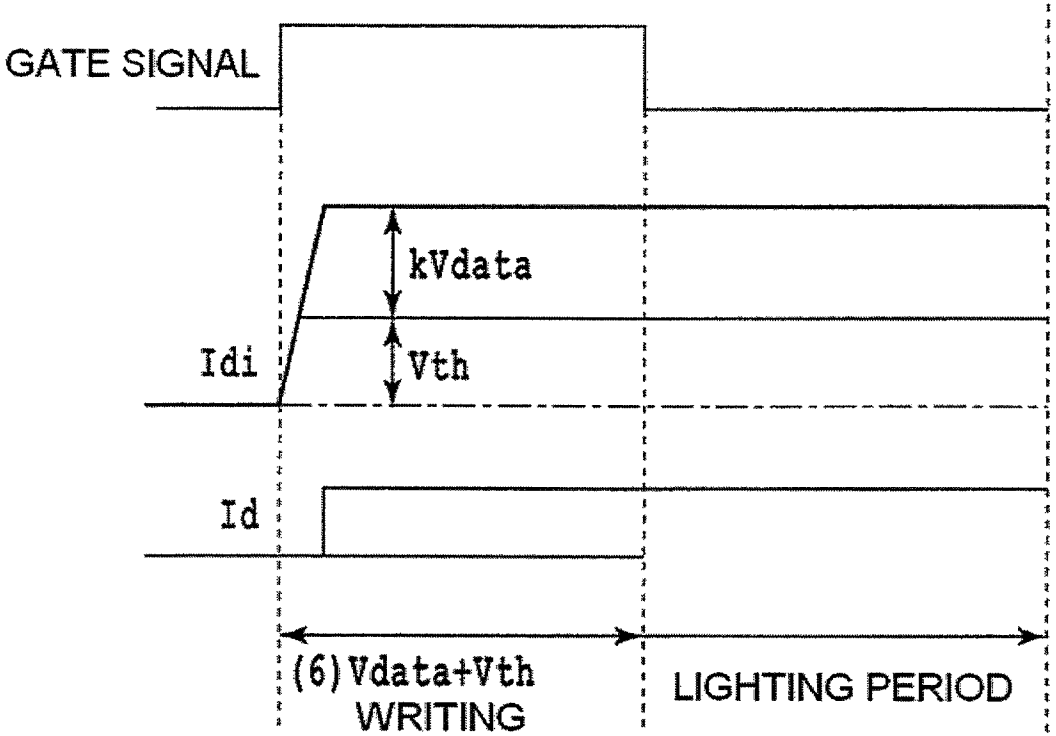
FIG. 4 is a diagram illustrating the operation timing at a display stage of FIG. 3.

FIG. 3 is a diagram for explaining input of gradation data Vdata 31 and driving of the pixel circuit on the basis of a corrected signal. In this operation, each pixel circuit is driven by the gradation voltage source alone. FIG. 4 illustrates the timing at which one pixel is driven in that operation. Signal flow and so forth in this case are denoted by a bold line in FIG. 3. The gradation data Vdata is multiplied by the coefficient K in the multiplier 27, and has Vth added thereto by the adder 28. This process is carried out digitally, as expressed by Equation (3). The resulting digital value is converted to an analog value by the gradation voltage source 29 (specifically, by an D/A converter) and is applied to the pixel circuit 19. As a result, the analog value is written to and stored in the capacitor 14, to update display data thereby.

$$Vg=K\cdot V\text{data}+Vth \qquad \text{Equation (3)}$$

Herein, Vdata is data for setting the luminance of emitted light (gradation) of the EL display device. At 100% gradation, Vdata has the same value as the above-described ΔVi. When Vth and electron mobility undergo initial variation and fluctuation over time, digital data is corrected through multiplication of the gradation voltage Vdata by a correction coefficient K other than 1, so as to reflect the further change in Vth.

Figure 6:
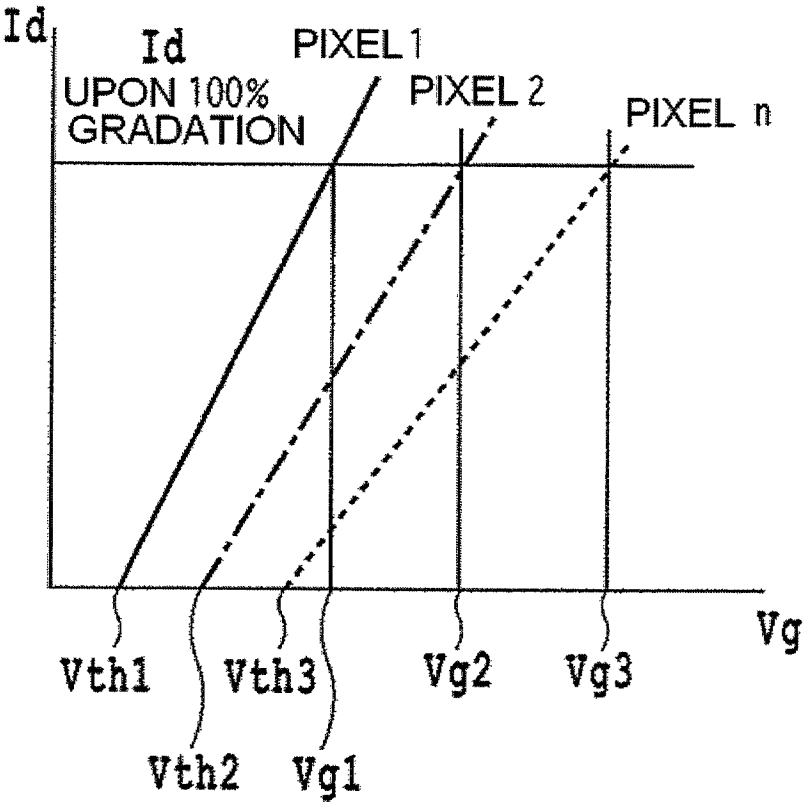
FIG. 6 is a diagram for explaining the effect of the display device of the present invention.

Thus, the gate voltage Vg is caused to change in such a manner that the Id of the driving transistor 12 takes on a constant current value with respect to 100% gradation input, as a result of which the relationship between luminance of emitted light relative to the gradation voltage Vdata becomes universal. FIG. 6 illustrates such an instance. FIG. 6 shows schematically that the driving current Id at 100% gradation does not change for an arbitrary change from Vg1 to Vg3 in the driving transistors of three respective pixels, even in case of initial variation or fluctuation over time of the Vth and the electron mobility of the pixels.

As a result, there occurs essentially no brightness non-uniformity derived from characteristic variation, which was conventionally of 50% or higher. Brightness non-uniformity drops thus to a negligible level, at or below that of computational error.

An embodiment has been explained above based on an illustrated example in which a basic process starts with reading of the Vth of a transistor in a pixel circuit, followed by obtention of a coefficient K related to electron mobility, and subsequent correction of inputted gradation on the basis of the foregoing data, up to driving of each pixel circuit using the corrected data.

However, the gist of the present invention can be realized through embodiments other than the above-described one. In the portion denoted as source driver 20, for instance, some of the features relating to the invention of the present application can be executed by a computer that outputs data for display on the display device, and the execution results may be stored in a storage device of the display device. That is, the embodiment can be configured so that the computing unit portions of the computing unit 25 and the computing unit 26 may be executed in an external device, and the results be stored in the computing unit 26. In this case, the computation executed by the external device may be executed in a computer according to a software program.

Control of the above-described calibration operation, specifically control by a control unit that controls the source driver, the gate driver, as well as driving of the A/D converter and current source, can be enabled in the above-mentioned computer. The calibration operation can be essentially controlled thus by a program in the computer. Since in such an embodiment the calibration operation can be controlled by a software program, a user can choose between time-consuming accurate calibration, or rough calibration that can be carried out quickly.

When the calibration operation is performed using a software program having the above features, the final results of the calculation of driving transistor characteristic can be obtained by including fine-tuning of the obtained measurement data. For instance, if the obtained threshold value can be expressed as a function of the actual threshold value, the desired threshold value can be obtained through execution of a process of that function, so that the process result is used as the threshold value. The threshold value can also be used upon simultaneous determination of the above-described K.

The A/D converter 22, the current source 21 and the gradation voltage source 30 must be provided in the display device, also in the above-described other embodiment. The Vth storage 24, the computation and storage 26, the multiplier 27 and the adder are also used in the gradation display stage, but the gist of the present invention can be realized regardless of whether these elements are inside or outside the display device. That is, the corrected gradation data can be inputted to the gradation voltage source 30 outside the display device.

It is also obvious that in the embodiment shown in the figures, the control of the various operations in the calibration stage can be executed in a dedicated computer arranged in the display device, or can be executed by one dedicated hardware item, or by a combination of the foregoing.

The above-described Vth and K of a transistor change little over short periods of time. Once the above-described calibration operation is executed, therefore, there is no need for a repeated calibration operation every time that the display device is used. The above-described calibration operation, though, is preferably carried out at regular intervals. Alternatively, the above-described calibration operation may be carried when display brightness non-uniformity becomes noticeable.

The present invention described above allows correcting gradation voltage in a display device in accordance with the initial variation, and fluctuation over time, of electron mobility and a threshold value of a transistor in a pixel circuit, whereupon the corrected voltage can be supplied to each pixel circuit. As a result, the present invention elicits the effect of reducing display brightness non-uniformity to a negligible level in a display device.

Figure 7:
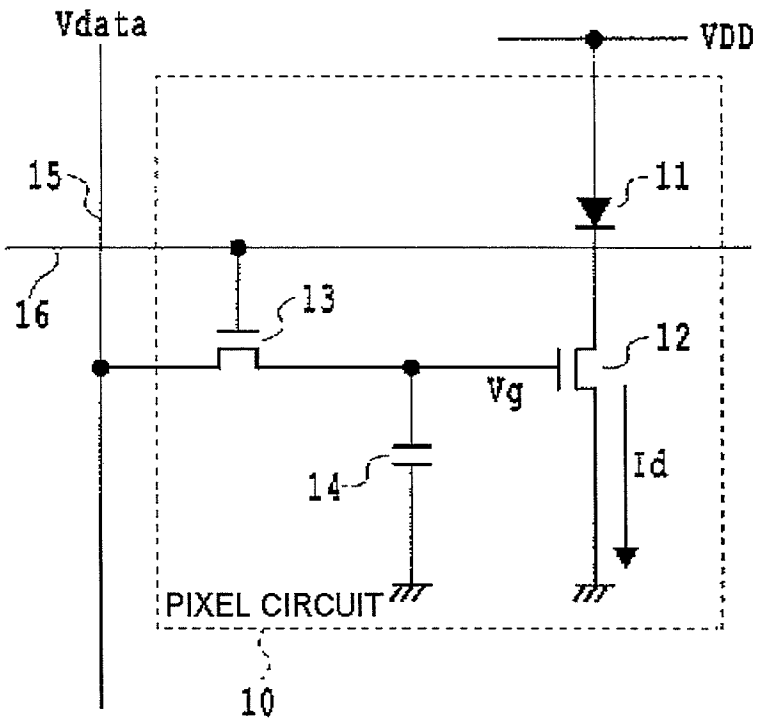
FIG. 7 PRIOR ART
FIG. 7 is a diagram illustrating a configuration example of one pixel circuit in an ordinary display device of active matrix type.
Figure 8:
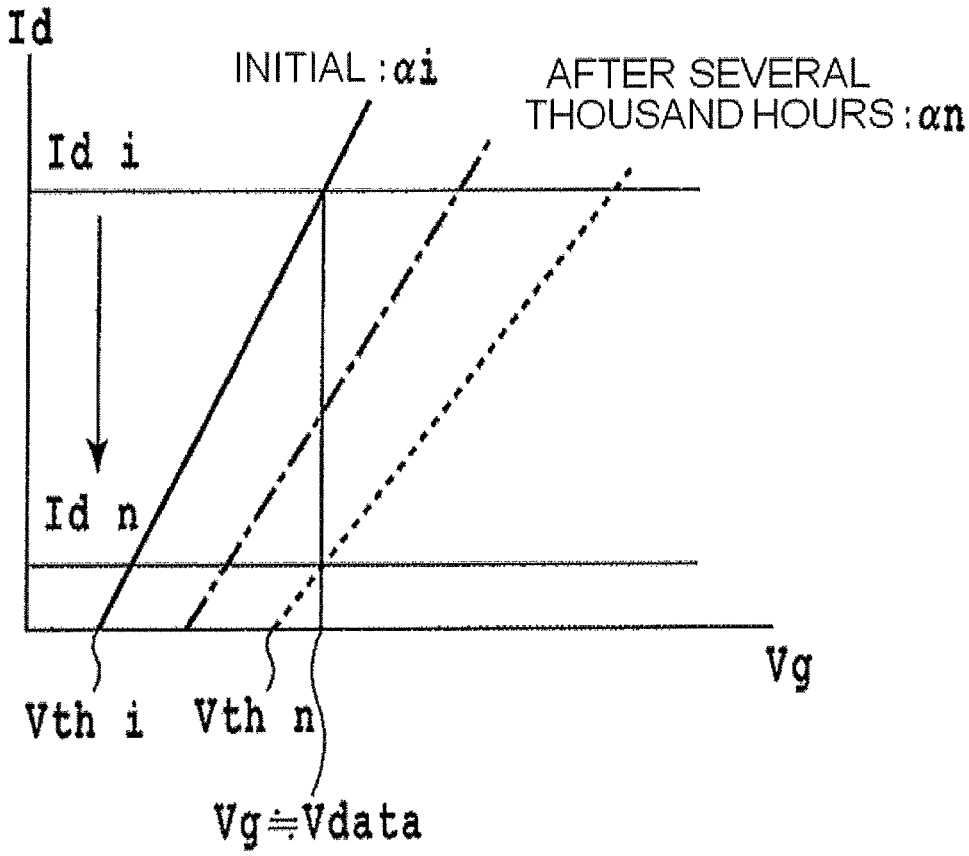
FIG. 8 PRIOR ART
FIG. 8 is a diagram illustrating an example of change over time of a transistor characteristic.

FIG. 1
20 SOURCE DRIVER
24 Vth STORAGE
22 A/D CONVERTER
21 CURRENT SOURCE Iref1, 2
29 GRADATION VOLTAGE SOURCE
19 PIXEL CIRCUIT
FIG. 2
GATE SIGNAL
PRECHARGE
AD CONVERSION
(1) PRECHARGE
(2) Vth STORAGE
(3) Vth READING
(4) Vref WRITING
(5) Vref READING Vth READING CYCLE
Vref READING CYCLE
COEFFICIENT COMPUTATION CYCLE
FIG. 3
20 SOURCE DRIVER
24 Vth STORAGE
22 A/D CONVERTER
21 CURRENT SOURCE Iref1, 2
29 GRADATION VOLTAGE SOURCE
31 GRADATION DATA Vdata
19 PIXEL CIRCUIT
FIG. 4
GATE SIGNAL
(6) Vdata+Vth WRITING
LIGHTING PERIOD
FIG. 5
AFTER N HOURS: ΔVn
Initial: ΔVi
FIG. 6
Id UPON 100% GRADATION
PIXEL 1
PIXEL 2
PIXEL n
FIG. 7
10 PIXEL CIRCUIT
FIG. 8
INITIAL: αi
AFTER SEVERAL THOUSAND HOURS: αn

The invention claimed is:

1. A display device of active matrix type, in which a plurality of emissive elements of current control type and a plurality of pixel circuits are formed as a matrix, configured to supply corrected gradation voltages for display to the pixel circuits, the display device comprising:

the pixel circuits configured to supply currents to the emissive elements, each pixel circuit comprising an input circuit configured to receive an input current to said each pixel circuit, and a driving transistor configured to supply a current flowing through a respective emissive element, the current flowing through the respective emissive element being configured to be proportional to the input current;

a measurement circuit, comprising a constant current supplying circuit configured to generate and supply one or more constant currents as input currents to the input circuit of said each pixel circuit in a time division manner, the measurement circuit A/D-converting output voltages of the constant current supplying circuit corresponding to the one or more constant currents, performing a predetermined operation on the A/D-converted data, and calculating data relating to electron mobility and threshold value of the driving transistor; and a gradation voltage supplying circuit configured to supply a corrected gradation voltage for display to said each pixel circuit, the corrected gradation voltage being data corrected on the basis of data calculated from the measurement circuit, wherein the gradation voltage supplying circuit multiplies data inputted thereto, which includes an original gradation voltage inputted to the display device and the data relating to the electron mobility of the driving transistor received from the measurement circuit; adds the threshold value of the driving transistor inputted from the measurement circuit to the result of the multiplication to generate the corrected gradation voltage; and supplies the corrected gradation voltage to said each pixel circuit.

2. The display device of active matrix type according to claim 1, wherein the measurement circuit stops current supply after supply of a constant current of a first value from the constant current supplying circuit; A/D-converts, into first data, a first output voltage of the constant current supplying circuit after stoppage; A/D-converts, into second data, a second output voltage of the constant current supplying circuit in a period in which a constant current of a second value is sustained; calculates a threshold value of the driving transistor of said pixel circuit on the basis of the first data; and calculates data relating to electron mobility of the driving transistor on the basis of the first and second data.

3. The display device of active matrix type according to claim 2, wherein the constant current of the second value is a current of a value that corresponds to a maximum brightness predetermined for the driving transistor.

4. The display device of active matrix type according to claim 1, wherein the input circuit of said each pixel circuit comprises a current mirror transistor of the driving transistor.

5. The display device of active matrix type according to claim 2, wherein the input circuit of the pixel circuits comprises a current mirror transistor of the driving transistor and the first output voltage denotes a threshold value of the current mirror transistor after discharge, via the current mirror transistor, of voltage charged in a capacitor connected to the gate of the driving transistor.

6. The display device of active matrix type according to claim 5, wherein the threshold value of the current mirror transistor corresponds to a threshold value of the driving transistor of said each pixel circuit.

7. The display device of active matrix type according to claim 2, wherein the input circuit of said each pixel circuit comprises a current mirror transistor of the driving transistor that drives the respective emissive element, the first voltage that yields the first data denotes a threshold value of the current mirror transistor after discharge, via the current mirror transistor, of voltage charged in a capacitor connected to the gate of the driving transistor of said each pixel circuit, the constant current of the second value is a current of a value that corresponds to a maximum brightness predetermined for the driving transistor, and the data relating to the electron mobility of the driving transistor is expressed by (Vn−Vth)/Vi, wherein Vth is the first data, Vn is the second data, and Vi is data denoting maximum brightness of gradation voltage that is inputtable to the display device.

8. The display device of active matrix type according to claim 1, further comprising a storage circuit configured to store, for said each pixel circuit, the calculated data from the measurement circuit, the calculated data relating to the electron mobility and threshold value of the driving transistor.

9. The display device of active matrix type according to claim 1, wherein the gradation voltage supplying circuit generates the corrected gradation voltage on the basis of the data calculated from the measurement circuit, the calculated data relating to the electron mobility and threshold value of the driving transistor in said each pixel circuit that supplies current to the respective emissive element.

10. The display device of active matrix type according to claim 1, wherein the corrected gradation voltage is supplied to the driving transistor in said each pixel circuit, so that the driving transistor generates a current to drive the respective emissive element according to the corrected gradation voltage.

11. A display device of active matrix type, in which a plurality of emissive elements of current control type and a plurality of pixel circuits are formed as a matrix, configured to supply corrected gradation voltages for display to the pixel circuits, the display device comprising:

the pixel circuits configured to supply currents to the emissive elements, each pixel circuit comprising a driving transistor configured to supply a current flowing through a respective emissive element;

a measurement circuit, comprising a constant current supplying circuit configured to generate and supply one or more constant currents as input currents to said each pixel circuit in a time division manner, the measurement circuit A/D-converting output voltages of the constant current supplying circuit corresponding to the one or more constant currents, performing a predetermined operation on the A/D-converted data, and calculating data relating to electron mobility and threshold value of the driving transistor; and a gradation voltage supplying circuit configured to supply a corrected gradation voltage for display to said each pixel circuit, the corrected gradation voltage being data corrected on the basis of data calculated from the measurement circuit, wherein the gradation voltage supplying circuit multiplies data inputted thereto, which includes an original gradation voltage inputted to the display device and the data relating to the electron mobility of the driving transistor received from the measurement circuit; adds the threshold value of the driving transistor inputted from the measurement circuit to the result of the multiplication to generate the corrected gradation voltage; and supplies the corrected gradation voltage to said each pixel circuit.

12. A display device of active matrix type configured to measure a threshold value of a driving transistor, in which a plurality of emissive elements of current control type and a plurality of pixel circuits are formed as a matrix, the display device comprising:

the pixel circuits configured to supply currents to the emissive elements, each pixel circuit comprising an input circuit configured to receive an input current to said each pixel circuit and the driving transistor configured to supply a current flowing through a respective emissive element, the current flowing through the respective emissive element being configured to be proportional to the input current;

a measurement circuit, comprising a constant current supplying circuit configured to generate and supply one or more constant currents as input currents to the input circuit of said each pixel circuit in a time division manner, the measurement circuit A/D-converting output voltages of the constant current supplying circuit corresponding to the one or more constant currents, performing a predetermined operation on the A/D-converted data, and calculating data relating to the threshold value of the driving transistor, wherein the measurement circuit stops current supply after supply of a constant current of a first value from the constant current supplying circuit; A/D-converts, into first data, a first output voltage of the constant current supplying circuit after stoppage; A/D-converts, into second data, a second output voltage of the constant current supplying circuit in a period in which a constant current of a second value is sustained; calculates a threshold value of the driving transistor of said pixel circuit on the basis of the first data; and calculates data relating to electron mobility of the driving transistor on the basis of the first and second data, the input circuit of said each pixel circuit comprises a current mirror transistor of the driving transistor that drives the respective emissive element, the first voltage that yields the first data denotes a threshold value of the current mirror transistor after discharge, via the current mirror transistor, of voltage charged in a capacitor connected to the gate of the driving transistor of said each pixel circuit, the constant current of the second value is a current of a value that corresponds to a maximum brightness predetermined for the driving transistor, and the data relating to the electron mobility of the driving transistor is expressed by $(Vn-Vth)/Vi$, wherein Vth is the first data, Vn is the second data, and Vi is data denoting maximum brightness of gradation voltage that is inputtable to the display device.

* * * * *